US011098689B2

(12) United States Patent
Shima et al.

(10) Patent No.: US 11,098,689 B2
(45) Date of Patent: Aug. 24, 2021

(54) IGNITION DEVICE FOR INTERNAL COMBUSTION ENGINE

(71) Applicant: Hitachi Automotive Systems, Ltd., Hitachinaka (JP)

(72) Inventors: Yasuo Shima, Ibaraki (JP); Koji Shibata, Hyogo (JP); Yoichiro Kobayashi, Ibaraki (JP)

(73) Assignee: HITACHI AUTOMOTIVE SYSTEMS, LTD., Hitachinaka (JP)

( * ) Notice: Subject to any disclaimer, the term of this patent is extended or adjusted under 35 U.S.C. 154(b) by 0 days.

(21) Appl. No.: 16/963,893

(22) PCT Filed: Jan. 11, 2019

(86) PCT No.: PCT/JP2019/000635
§ 371 (c)(1),
(2) Date: Jul. 22, 2020

(87) PCT Pub. No.: WO2019/150915
PCT Pub. Date: Aug. 8, 2019

(65) Prior Publication Data

US 2021/0033058 A1 Feb. 4, 2021

(30) Foreign Application Priority Data

Feb. 1, 2018 (JP) ..... JP2018-016237

(51) Int. Cl.
*F02P 3/04* (2006.01)

(52) U.S. Cl.
CPC ..... *F02P 3/0407* (2013.01)

(58) Field of Classification Search
CPC ..... F02P 3/0404; F02P 3/051; F02P 3/0552; F02P 9/002
See application file for complete search history.

(56) References Cited

U.S. PATENT DOCUMENTS

2009/0229581 A1* 9/2009 Ikeda ..... C01B 13/10 123/536
2013/0199510 A1* 8/2013 Shibata ..... F02P 3/0407 123/634

FOREIGN PATENT DOCUMENTS

JP H10-103148 A 4/1998
JP 2017-002818 A 1/2017
(Continued)

OTHER PUBLICATIONS

International Search Report with English translation and Written Opinion issued in corresponding application No. PCT/JP2019/000635 dated Apr. 10, 2019.

*Primary Examiner* — George C Jin
(74) *Attorney, Agent, or Firm* — Foley & Lardner LLP

(57) ABSTRACT

It is made possible to control ignition appropriately.
An ignition device 1 for an internal combustion engine includes a spark coil 50 including: a primary side coil 51 connected to a direct current power supply 40 and a secondary side coil 52 magnetically connected to the primary side coil 51 and connected to an ignition plug 60; a switch element 30 that performs switching between energization and interruption of primary current I1 to the primary side coil 51; and a switch element controlling circuit 20 that controls the switch element 30 on the basis of an ignition controlling signal 51 supplied from an ECU 10. A turn-on delay adjustment circuit 22 that delays a control timing of the switch element 30 is disposed between the ECU 10 and the switch element 30 such that first resonance noise generated due to interruption of the primary current I1 to the primary side coil 51 is reduced.

6 Claims, 6 Drawing Sheets

(56) References Cited

FOREIGN PATENT DOCUMENTS

| | | | | |
|---|---|---|---|---|
| JP | 2017002818 | A | * | 1/2017 |
| JP | 2017-218973 | A | | 12/2017 |

* cited by examiner

IGNITION DEVICE FOR INTERNAL COMBUSTION ENGINE

TECHNICAL FIELD

The present invention relates to an ignition device for an internal combustion engine that includes a spark coil.

BACKGROUND ART

An ignition device for an internal combustion engine, for example, for an automobile performs switching between energization and interruption of primary current to a primary side coil of a spark coil in response to an ignition controlling signal supplied from an ECU (Electronic Control Unit). Consequently, due to interruption of primary current to a primary side coil, the ignition device causes the ignition plug to generate a spark to ignite air fuel mixture in a cylinder of the internal combustion engine by an induced voltage (secondary voltage) generated in a secondary side coil magnetically connected to the primary side coil.

The ignition device is located in the proximity of the internal combustion engine through a harness. However, it is demanded for the ignition device not to suffer from occurrence of failure or malfunction when surge or intensive electromagnetic noise is induced in the harness. Accordingly, various surge resistance experiments and EMC (Electro Magnetic Compatibility) experiments for measuring a surge or strong electromagnetic noise induced in the harness are prescribed.

Incidentally, in order to generate a very high induction voltage at the time of interruption of primary current to the primary side coil, it is demanded for the ignition device to prevent malfunction and characteristic degradation by an influence of noise generated due to ignition control.

Patent Document 1 discloses an ignition device in which, before the primary current is energized to the primary side coil on the basis of an ignition signal, it is suppressed that a quickly rising pulse voltage is generated in a secondary voltage by ON voltage suppressing means for charging a stray capacitance component of the primary side coil in advance.

PRIOR ART DOCUMENT

Patent Document

Patent Document 1: JP-2017-2818-A

SUMMARY OF THE INVENTION

Problems to be Solved by the Invention

Here, when switching of primary current to the primary side coil is performed between energization and interruption, an induction voltage is generated in the spark coil and also various types of noise occur. Especially, in the case where a high voltage is to be generated in the secondary side coil to cause the ignition plug to generate a spark at the time of interruption of the primary current, noise is generated remarkably. The high voltage generated in the secondary side coil causes resonance by inductive components and capacitive components of a power supply line disposed between the spark coil and a direct current power supply, and causes resonance noise to be generated in the power supply line. The resonance noise generated in the power supply line is injected into an ignition controlling signal by line coupling between the power supply line disposed between the spark coil and the direct current power supply and a signal line for transmitting the ignition controlling signal from the ECU to the spark coil. In the case where the resonance noise injected in the ignition controlling signal has an amplitude level with which the polarity of the ignition controlling signal supplied from the ECU is reversed, unintended induction and interception are repeated in the primary side coil after interruption control of the primary current to the primary side coil. If an unintended behavior of the primary current occurs immediately after the interruption of the primary current, then also the secondary voltage oscillates in response to the behavior of the primary current. Therefore, in the case where a voltage necessary for a spark of the ignition plug is not obtained, this sometimes leads to misfire of the internal combustion engine.

In the ignition device disclosed in Patent Document 1, resonance noise to be generated upon energization of the primary current to the primary side coil is suppressed. However, also at the time of interruption of the primary current, noise having oscillation greater than that of resonance noise that is generated at the time of energization of the primary current is generated. In the case where the resonance noise generated due to interruption of the primary current wraps around to an ignition signal, there is the possibility that a periodical pulse removing process of the resonance noise may be required continuously and it is worried that the ignition responsibility based on the ignition signal supplied from the ECU is degraded. Further, in the case where the resonance noise has an amplitude level with which the polarity is reversed with respect to the ignition signal, since useless stress is applied to the ignition device, it is necessary to converge the noise quickly.

The present invention has been made in view of such a situation as described above, and it is an object of the present invention to provide a technology that can control ignition appropriately.

Means for Solving the Problems

An ignition device for an internal combustion engine according to a first aspect for solving the subject described above includes a spark coil including a primary side coil connected to a direct current power supply and a secondary side coil magnetically connected to the primary side coil and connected to an ignition plug, a switch element configured to perform switching between energization and interruption of primary current to the primary side coil, and a switch element controlling unit configured to control the switch element on a basis of an ignition controlling signal supplied from an electronic controlling device. In the ignition device, a delaying unit that delays a control timing of the switch element is disposed between the electronic controlling device and the switch element such that first resonance noise generated due to interruption of the primary current to the primary side coil is reduced.

Advantages of the Invention

With the present invention, ignition can be controlled suitably.

MODE FOR CARRYING OUT THE INVENTION

Several embodiments are described in detail with reference to the drawings. It is to be noted that the embodiments described below do not restrict the invention according to the claims, and all of factors and combinations of them described in connection with the embodiments may not necessarily be essential to the solving means of the invention.

First Embodiment

Figure 1:
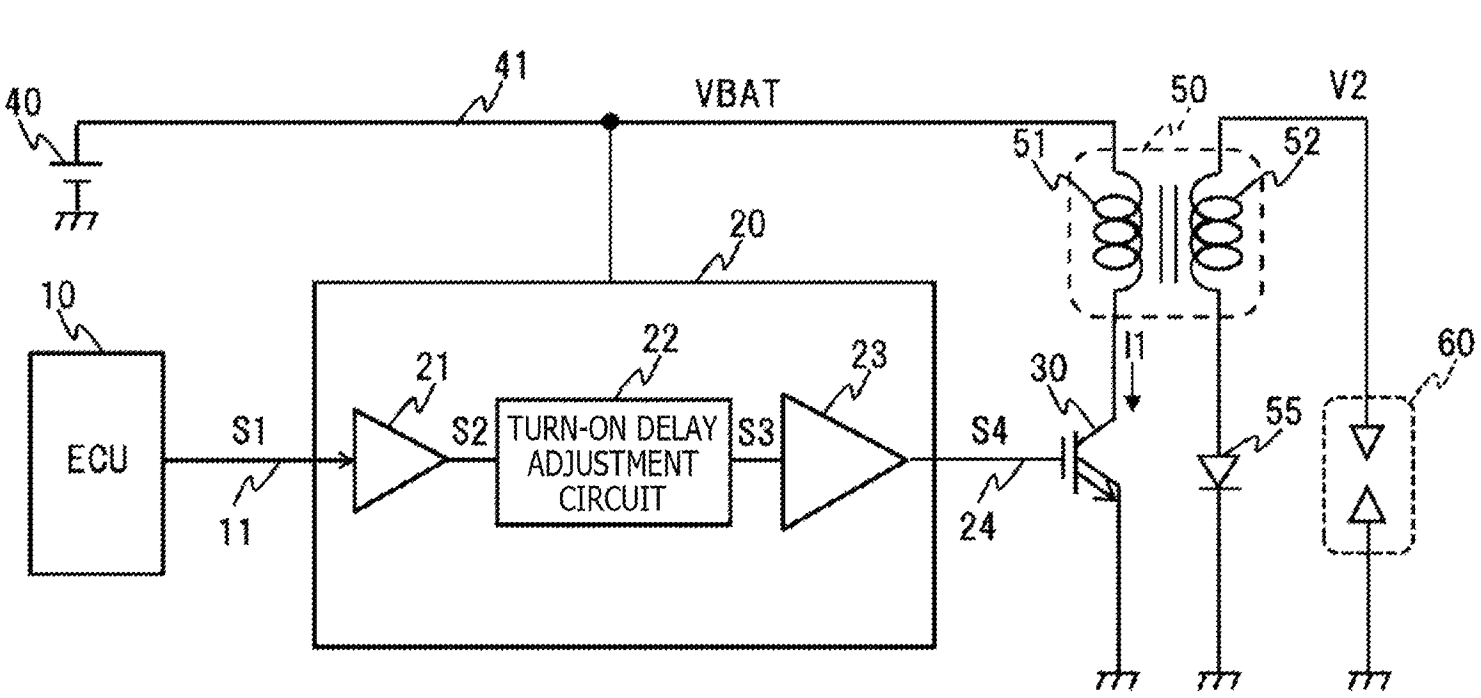
FIG. 1 is a block diagram of an ignition device according to a first embodiment.

FIG. 1 is a block diagram of an ignition device according to a first embodiment.

An ignition device 1 is an ignition device, for example, of an internal combustion engine (hereinafter referred to as engine) incorporated in an automobile. The ignition device 1 includes an ECU (Electronic Control Unit) 10 as an example of an "electronic controlling device," a switch element controlling circuit 20 as an example of a "switch element controlling unit," a switch element 30, a direct current power supply 40 such as an on-vehicle battery, a spark coil 50 and an ignition plug 60.

The ECU 10 is electrically connected to the switch element controlling circuit 20 through a signal line 11. The ECU 10 controls operation of the engine. For example, the ECU 10 outputs an ECU command signal S1 as part of an "ignition controlling signal" for indicating an ignition timing of the ignition plug 60 on the basis of rotation of the engine.

The switch element controlling circuit 20 includes an inputting circuit 21, a turn-on delay adjustment circuit 22 as an example of a "delaying unit" and a pre-driver circuit 23. The inputting circuit 21 is electrically connected to the turn-on delay adjustment circuit 22. The turn-on delay adjustment circuit 22 is electrically connected to the pre-driver circuit 23. The pre-driver circuit 23 is electrically connected to the switch element 30 through a signal line 24.

The inputting circuit 21 receives the ECU command signal S1 outputted from the ECU 10. The inputting circuit 21 shapes the received ECU command signal S1 to produce an ignition controlling signal S2 and outputs the produced ignition controlling signal S2 to the turn-on delay adjustment circuit 22. The turn-on delay adjustment circuit 22 produces a post delay adjustment signal S3 to which an appropriate delay amount Td (refer to FIG. 2, referred to sometimes as turn-on delay) has been provided upon ignition control and outputs the produced post delay adjustment signal S3 to the pre-driver circuit 23. The delay amount Td may be increased as the time period for which the ignition controlling signal S2 exceeds a threshold value increases. The pre-driver circuit 23 produces a pre-driver signal S4 for driving the switch element 30 on the basis of the post delay adjustment signal S3 and outputs the produced pre-driver signal S4 to the switch element 30.

The switch element 30 includes a controlling terminal electrically connected to the signal line 24, a grounding terminal electrically connected to the GND and an energization terminal electrically connected to a primary side coil 51 of the spark coil 50. The pre-driver signal S4 outputted from the pre-driver circuit 23 is inputted to the switch element 30. The switch element 30 performs switching between energization and interruption of primary current I1 to the primary side coil 51 of the spark coil 50 in response to the pre-driver signal S4. It is to be noted that the switch element 30 may be an IGBT (Insulated Gate Bipolar Transistor).

The spark coil 50 includes the primary side coil 51 and a secondary side coil 52 magnetically coupled to the primary side coil 51.

A high-voltage end of the primary side coil 51 is electrically connected to the direct current power supply 40 through a power supply line 41. A low-voltage end of the primary side coil 51 is electrically connected to the GND through the switch element 30.

One end of the secondary side coil 52 is electrically connected to the ignition plug 60. The other end of the secondary side coil 52 is connected to the GND through an on voltage preventing diode 55.

If the switch element 30 is switched from on to off (is turned off), then the primary current I1 energized to the primary side coil 51 is interrupted and the spark coil 50 configured in such a manner as described above transits from an energization state to an interruption state. At this time, a negative high voltage (hereinafter referred to as secondary voltage V2) is generated in the secondary side coil 52 and the ignition plug 60 generates a spark.

On the other hand, if the switch element 30 is switched from off to on (is turned on), then the primary current I1 is energized to the primary side coil 51 and the spark coil 50 transits from the interruption state to the energization state. At this time, a voltage of the reverse polarity to that upon interruption is generated on the secondary side coil 52. It is to be noted that the generated reverse polarity voltage is suppressed by the on voltage preventing diode 55.

Figure 2:
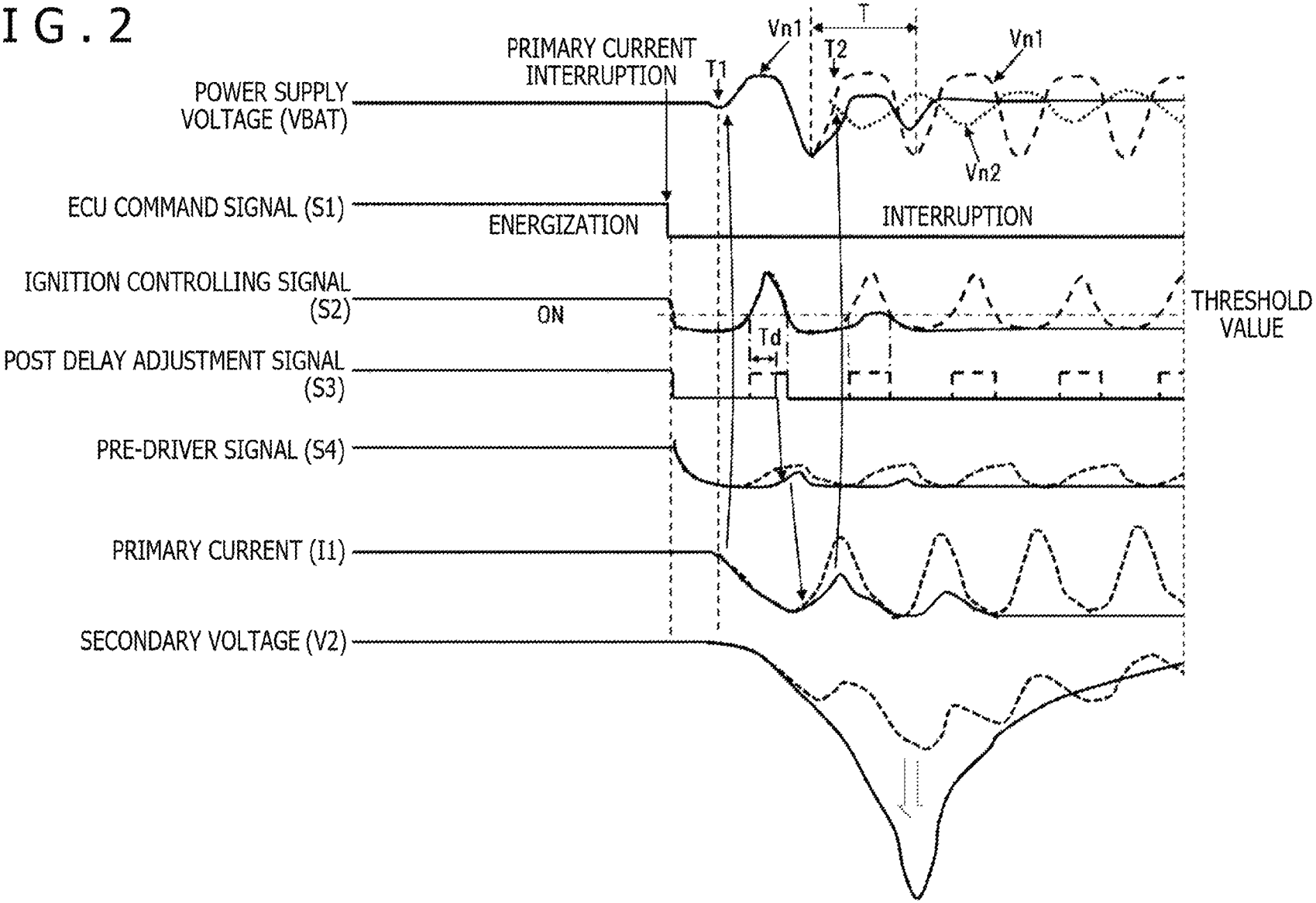
FIG. 2 is a timing chart illustrating a variation of a signal of the ignition device according to the first embodiment.

FIG. 2 is a timing chart illustrating a variation of a signal of the ignition device according to the first embodiment. It is to be noted that, in FIG. 2, a power supply voltage (VBAT), an ECU command signal (S1), an ignition controlling signal (S2), a post delay adjustment signal (S3), a pre-driver signal (S4), primary current (I1) and a secondary voltage (V2) are depicted in order from above.

Here, at the time of interruption of the primary current I1 to the primary side coil 51, resonance by an inductive component and a capacitive component of the power supply line 41 between the spark coil 50 and the direct current power supply 40 is sometimes caused by the secondary voltage V2 generated in the secondary side coil 52. If first resonance noise Vn1 is generated in the power supply line 41 at time T1, then the first resonance noise Vn1 is injected into a power supply voltage VBAT. The first resonance noise Vn1 generated in the power supply line 41 is injected into the ECU command signal S1 by coupling of the power supply line 41 and the signal line 11 and is recognized as a command inputted from the ECU 10. Accordingly, the ignition controlling signal S2 becomes such a signal that ON and OFF are periodically repeated despite that the ECU command signal S1 (a signal actually outputted from the ECU 10 is depicted in FIG. 2) is in an interruption state.

In particular, the switch element controlling circuit 20 controls the switch element 30 on the basis of the polarity of the ECU command signal S1. Therefore, if the first resonance noise Vn1 is generated on the power supply line 41, then the primary current I1 repeats the energization state and the interruption state. As a result, the secondary voltage V2 sometimes oscillates in response to the behavior of the primary current I1 and becomes lower than a voltage necessary for a spark of the ignition plug 60.

Therefore, the turn-on delay adjustment circuit 22 controls the switch element 30 such that the first resonance noise Vn1 generated due to interruption of the primary current to the primary side coil 51 is reduced.

In particular, the first resonance noise Vn1 causes the primary current I1 to the primary side coil 51 to be energized again at time T2 after inputted to the ignition controlling signal S2 of the switch element controlling circuit 20. If the primary side coil 51 is energized again by the first resonance noise Vn1, then second resonance noise Vn2 due to the energization is generated in the power supply line 41. In the case where the second resonance noise Vn2 has a reverse phase to a phase of the first resonance noise Vn1, the first resonance noise Vn1 is attenuated. Accordingly, the turn-on delay adjustment circuit 22 delays the control timing (turn on) of the switch element 30 such that the second resonance noise Vn2 has a reverse phase (phase difference of approximately 180 degrees) with respect to the first resonance noise Vn1 at the generation timing (time T2).

Consequently, the second resonance noise Vn2 acts in such a direction that the first resonance noise Vn1 is weakened (cancelled), and the first resonance noise Vn1 can be attenuated quickly. As a result, energization of the primary current I1 to the primary side coil 51 due to the first resonance noise Vn1 after that can be cancelled or the energization time period can be set to an energization time period almost ignored, and a desired secondary voltage V2 can be obtained and ignition by the ignition plug 60 can be controlled appropriately.

It is to be noted that the turn-on delay adjustment circuit 22 may cause the switch element 30 to interrupt the primary current I1 to the primary side coil 51 when the ignition controlling signal S2 becomes lower than the threshold value. In particular, the turn-on delay adjustment circuit 22 may not delay the turn off timing of the switch element 30. Consequently, ignition responsibility of the spark coil 50 can be secured.

Here, it is supposed that the oscillation period T of the first resonance noise Vn1 generated due to interruption of the primary current I1 to the primary side coil 51 is approximately several tens μs on the basis of a parameter of the power supply line 41 between the spark coil 50 and the direct current power supply 40. Accordingly, the turn-on delay adjustment circuit 22 can delay the energization timing of the primary current I1 to the primary side coil 51 due to the first resonance noise Vn1 using a comparatively low-cost circuit. It is to be noted that, in the case where the control timing (energization time) of the primary current I1 to the primary side coil 51 is to be delayed, an influence by the delay on the oscillation period T (approximately several tens μs) of the first resonance noise Vn1 can be ignored since the energization time period of the primary side coil 51 necessary for a spark of the ignition plug 60 is shorter than 2 to 5 ms.

Second Embodiment

Now, an ignition device according to a second embodiment is described. It is to be noted that, in the ignition device 2 according to the second embodiment, the switch element controlling circuit is different in configuration from the ignition device 1 according to the first embodiment. Like elements to those in the first embodiment are denoted by like reference characters, and description of them is omitted.

Figure 3:
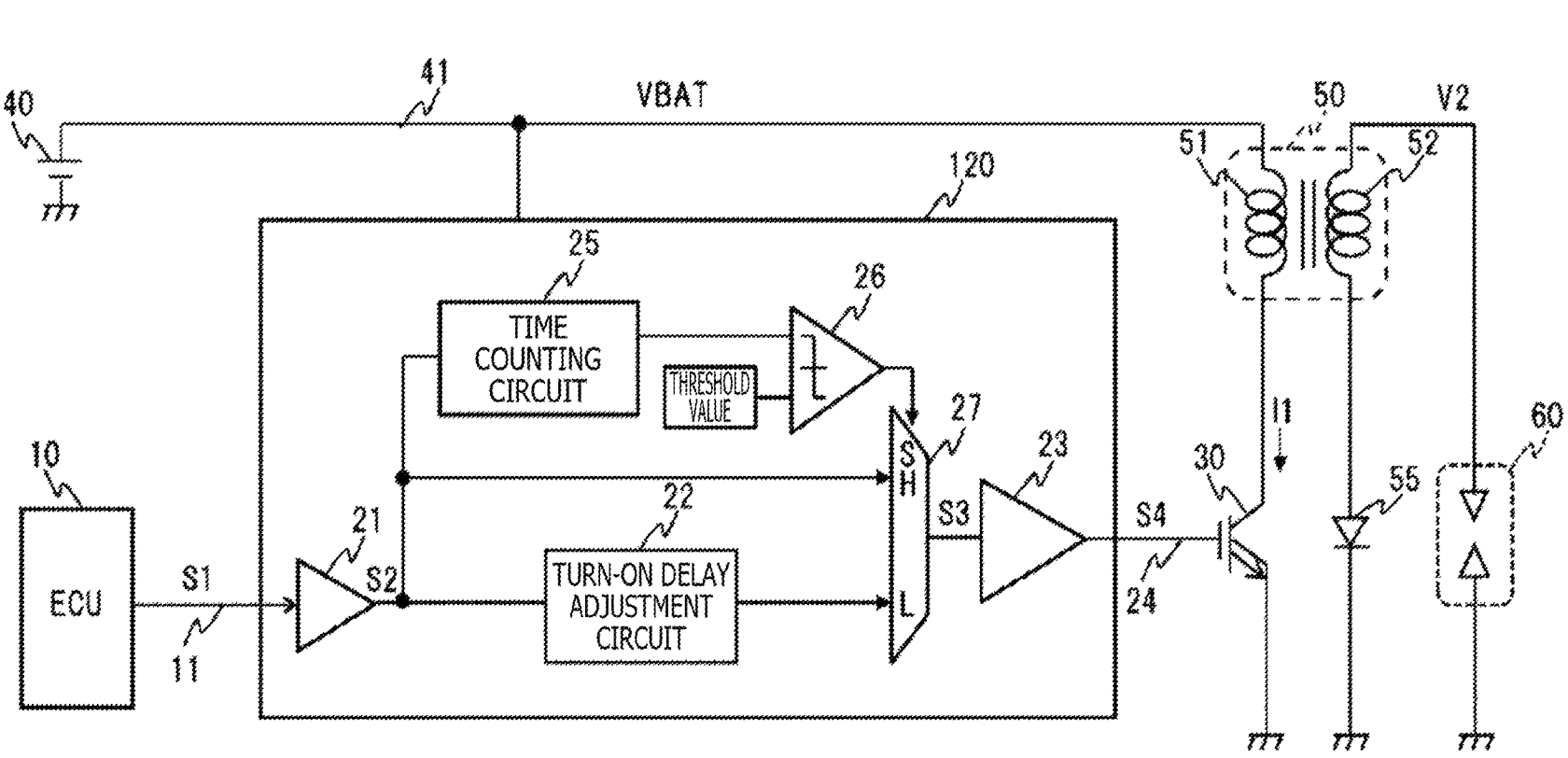
FIG. 3 is a block diagram of an ignition device according to a second embodiment.

FIG. 3 is a block diagram of the ignition device according to the second embodiment.

A switch element controlling circuit 120 of the ignition device 2 according to the second embodiment includes a time counting circuit 25 as an example of a "time counting unit," a decision circuit 26 and a path selection circuit 27 in addition to the inputting circuit 21, turn-on delay adjustment circuit 22 and pre-driver circuit 23.

The time counting circuit 25 measures interruption time period of the ignition signal S1. The decision circuit 26 decides whether or not a result of measurement by the time counting circuit 25 (interruption time period) is within a range of a predetermined period of time (from a lower limit threshold value to an upper limit threshold value). The path selection circuit 27 selects a path that adds a turn-on delay and another path that does not add a turn-on delay on the basis of a result of the decision by the decision circuit 26. The path selection circuit 27 may select whether or not turn-on delay adjustment is to be performed on the basis of the length of the interruption time period just before energization control.

For example, in the case where a result of the measurement by the time counting circuit 25 (interruption time period) is longer than the oscillation period T of the first resonance noise Vn1, the path selection circuit 27 may control the switch element 30 on the basis of the ignition controlling oscillation S2. In other words, the pass selection circuit 27 may not delay the energization timing of the primary current I1 to the primary side coil 51 by the first resonance noise Vn1.

In particular, a minimum value of a normally supposed interruption time period of the ignition signal S1 is equal to a value obtained by subtracting the energization time period of the spark coil 50 necessary for generation of a spark by the ignition plug 60 from a minimum value of the ignition cycle calculated on the basis of a maximum speed of the engine. In the case of a four-stork engine, if the maximum speed of the engine is assumed to be 8000 rpm, then the minimum value of the ignition cycle is 15 ms (=66.6 Hz), and, even if the maximum speed of the engine is assumed to be 12000 rpm, the minimum value of the ignition cycle is 10 ms (=100 Hz). If it is assumed that the energization time period of the spark coil 50 necessary for generation of a spark by the ignition plug 60 is 2 to 5 ms, then the normally supposed minimum value of the interruption time period is 5 ms. Accordingly, in the case where the interruption time period of the ignition signal S1 immediately before energization to the primary side coil 51 is sufficiently longer than the oscillation period T of the first resonance noise Vn1, the signal is decided as a normal ignition signal S1 of the ECU 10, and a turn-on delay may not be added and the energization timing of the primary current I1 to the primary side coil 51 may not be varied.

Further, in the case where a result of the measurement by the time counting circuit 25 (interruption time period) is shorter than the oscillation period T of the first resonance noise Vn1, the path selection circuit 27 may control the switch element 30 on the basis of the ignition controlling oscillation S2. In other words, the path selection circuit 27 may not delay the energization timing of the primary current I1 to the primary side coil 51 by the first resonance noise Vn1. This also makes it possible not to extend a comparatively short interruption time period generated by a serge or noise of disturbance.

Third Embodiment

Now, a turn-on delay adjustment circuit according to a third embodiment is described. It is to be noted that the ignition device according to the third embodiment is difference in configuration of the turn-on delay adjustment circuit from the ignition device 1 according to the first embodiment. Like elements to those in the configuration of the first embodiment are denoted by like reference characters, and description of them is omitted.

Figure 4:
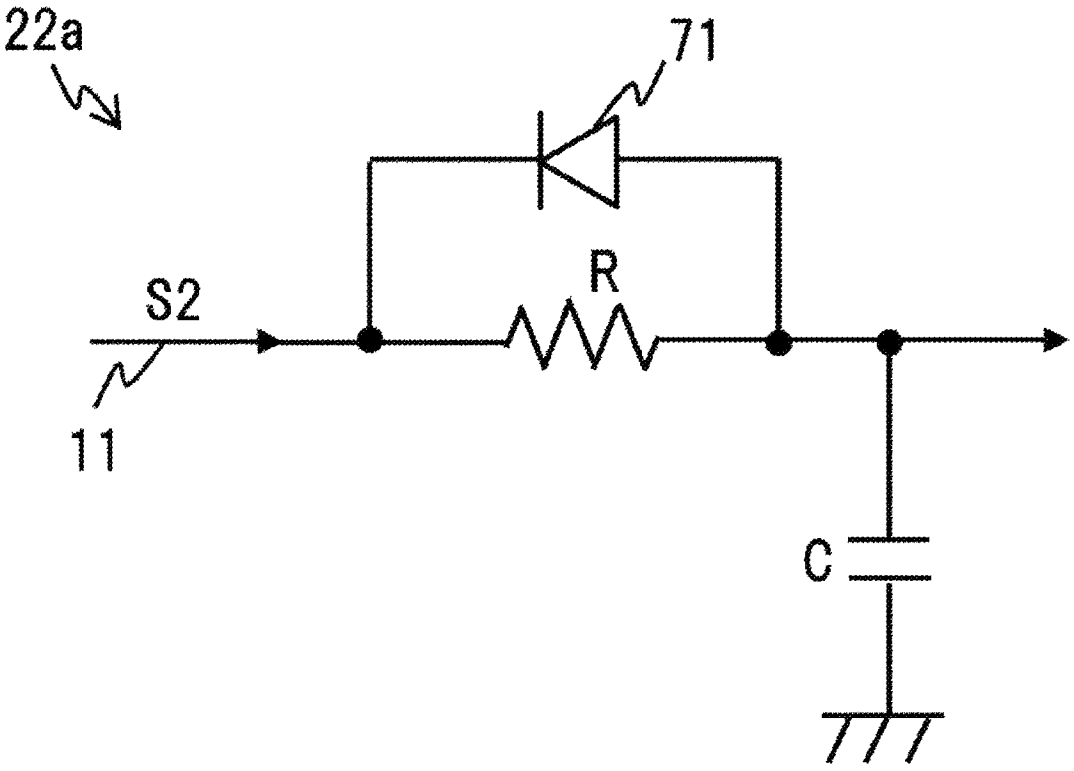
FIG. 4 is a configuration diagram of a turn-on delay adjustment circuit according to a third embodiment.

FIG. 4 is a configuration diagram of the turn-on delay adjustment circuit according to the third embodiment.

The turn-on delay adjustment circuit 22*a* of the ignition device according to the third embodiment is an analog circuit that includes, in the case where the high level of the ignition controlling signal S2 is used for energization while the low level of the ignition controlling signal S2 is used for an interruption polarity, a primary delay filter including a resistor R and a capacitor C and a diode 71 for bypassing the resistor R upon turn off.

Fourth Embodiment

Now, a turn-on delay adjustment circuit according to a fourth embodiment is described. It is to be noted that the ignition device according to the fourth embodiment is different in configuration of the turn-on delay adjustment circuit from the ignition device 1 according to the first embodiment. Like elements to those in the configuration of the first embodiment are denoted by like reference characters, and description of them is omitted.

Figure 5:
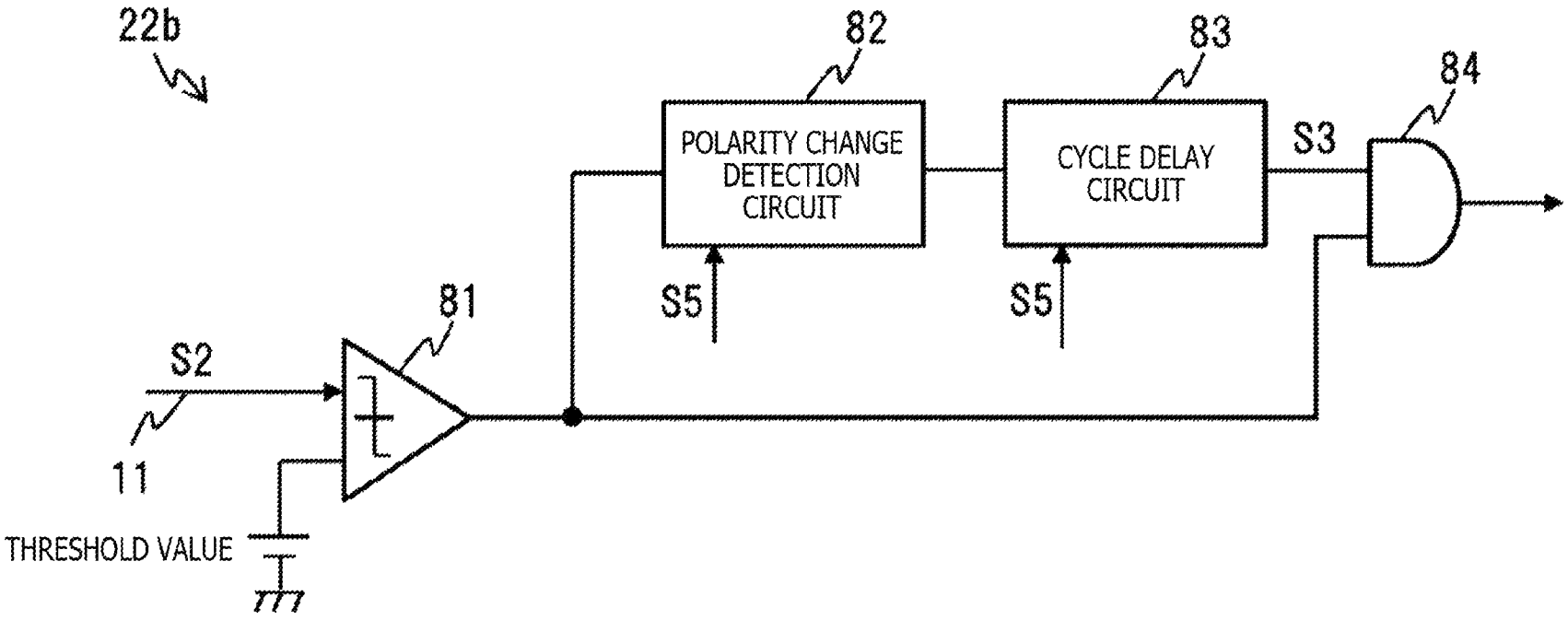
FIG. 5 is a block diagram of a turn-on delay adjustment circuit according to a fourth embodiment.

FIG. 5 is a block diagram of the turn-on delay adjustment circuit according to the fourth embodiment.

The turn-on delay adjustment circuit 22*b* of the ignition device according to the fourth embodiment is a digital circuit including a comparison decision circuit 81, a polarity change detection circuit 82, a cycle delay circuit 83 and an AND circuit 84.

The comparison decision circuit 81 determines a level of the ignition controlling signal S2 higher than a specific threshold value as a high level and determines another level of the ignition controlling signal S2 lower than the specific threshold value as a low level to decide the polarity. The polarity change detection circuit 82 detects a polarity change of the ignition controlling signal S2 from the low level to the high level. Only in the case where the polarity change detection circuit 82 detects a polarity change of the ignition controlling signal S2 from the low level to the high level, the cycle delay circuit 83 produces a post delay adjustment signal S3 to which a delay by a predetermined cycle period has been added using a cycle period of a reference period signal S5 as a minimum unit. The AND circuit 84 outputs the post delay adjustment signal S3 only in the case where both of the output of the cycle delay circuit 83 (post delay adjustment signal S3) and the output of the comparison decision circuit 81 (ignition controlling signal S2) individually have a high level.

Fifth Embodiment

Now, an ignition device according to a fifth embodiment is described. It is to be noted that the ignition device 5 according to the fifth embodiment is different in configuration of the switch element controlling circuit from the ignition device according to the first embodiment. Like elements to those in the configuration of the first embodiment are denoted by like reference characters, and description of them is omitted.

Figure 6:
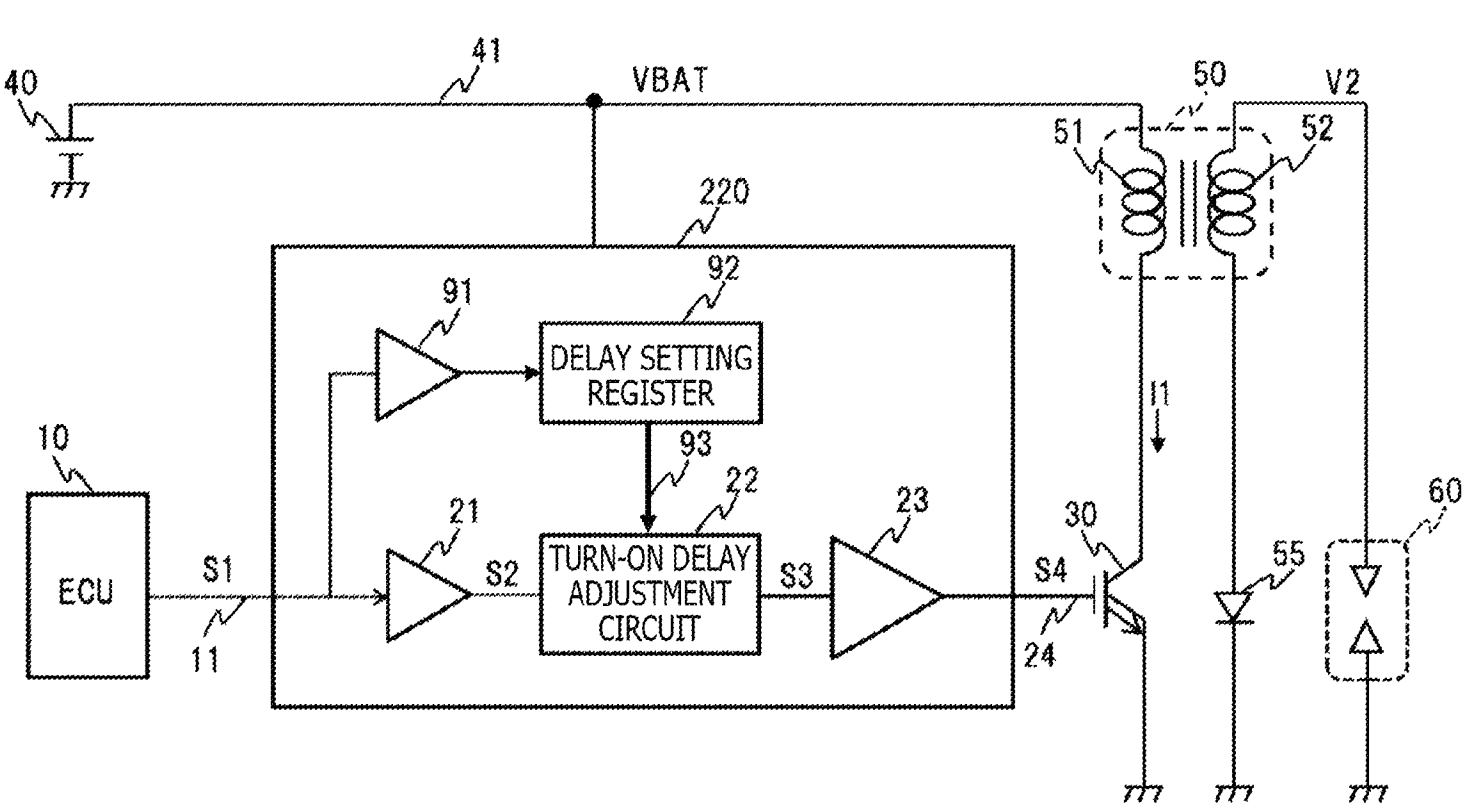
FIG. 6 is a block diagram of an ignition device according to a fifth embodiment.

FIG. 6 is a block diagram of an ignition device according to the fifth embodiment.

The switch element controlling circuit 220 of the ignition device 5 according to the fifth embodiment includes a comparator 91 and a delay setting register 92 in addition to the inputting circuit 21, turn-on delay adjustment circuit 22 and pre-driver circuit 23.

The comparator 91 decides a kind of the ECU command signal S1. The delay setting register 92 has a delay amount map in which a delay amount Td of the control timing of the switch element 30 according to a kind of the ECU command signal S1 is recorded as a register setting value 93. The delay setting register 92 outputs the register setting value 93 to the turn-on delay adjustment circuit 22 on the basis of a result of the decision of the comparator 91 and the delay amount map.

The present invention is not limited to the embodiments described above and includes various modifications.

For example, the embodiments described above are described in detail in order to explain the present invention clearly and are not necessarily limited to those that include all configurations described above. Further, it is possible to replace part of the configuration of a certain embodiment with a component of some other embodiment, and also it is possible to add, to the configuration of certain embodiment, the configuration of some other embodiment. The controlling lines and signal lines are indicated where they are considered necessary for the description, and all of the controlling lines and signal lines in products are not necessarily indicated.

For example, the turn-on delay adjustment circuits 22, 22*a* and 22*b* of the embodiments described above are disposed on the downstream side of the inputting circuit 21. The configuration is not limited to this, and the turn-on delay adjustment circuits 22, 22*a* and 22*b* may be disposed on the upstream side of the inputting circuit 20 and may be arranged between the coupling point at which the first resonance noise Vn1 is injected between the power supply line 41 and the signal line 11 and the switch element 30.

Further, for example, in the case where the first resonance noise Vn1 appears over a plurality of oscillation periods T, the turn-on delay adjustment circuits 22, 22*a* and 22*b* may increase the delay amount Td of the control timing of the switch element 30 in a later oscillation period with respect to a preceding oscillation period. Consequently, attenuation of the first resonance noise Vn1 generated periodically can be hastened.

DESCRIPTION OF REFERENCE CHARACTERS

1: Ignition device
2: Ignition device
5: Ignition device
10: ECU
20: Switch element controlling circuit
22: Turn-on delay adjustment circuit
22*a*: Turn-on delay adjustment circuit
22*b*: Turn-on delay adjustment circuit
25: Time counting circuit
30: Switch element
40: Direct current power supply
50: Spark coil
51: Primary side coil
52: Secondary side coil

60: Ignition plug
120: Switch element controlling circuit
220: Switch element controlling circuit
I1: Primary current
S1: ECU command
S2: Ignition controlling signal
T: Oscillation period
Td: Delay amount
Vn1: First resonance noise
Vn2: Second resonance noise

The invention claimed is:

1. An ignition device for an internal combustion engine, comprising:

a spark coil including a primary side coil connected to a direct current power supply, and a secondary side coil magnetically connected to the primary side coil and connected to an ignition plug;

a switch element configured to perform switching between energization and interruption of primary current to the primary side coil; and a switch element controlling unit configured to control the switch element on a basis of an ignition controlling signal supplied from an electronic controlling device, wherein a delaying unit that delays a control timing of the switch element is disposed between the electronic controlling device and the switch element such that first resonance noise generated due to interruption of the primary current to the primary side coil is reduced, the delaying unit comprising:

a time counting unit configured to count an interruption time period of the ignition controlling signal, wherein the delaying unit delays the control timing of the switch element on a basis of the interruption time period.

2. An ignition device for an internal combustion engine comprising:

a spark coil including a primary side coil connected to a direct current power supply, and a secondary side coil magnetically connected to the primary side coil and connected to an ignition plug;

a switch element configured to perform switching between energization and interruption of primary current to the primary side coil; and a switch element controlling unit configured to control the switch element on a basis of an ignition controlling signal supplied from an electronic controlling device, wherein a delaying unit that delays a control timing of the switch element is disposed between the electronic controlling device and the switch element such that first resonance noise generated due to interruption of the primary current to the primary side coil is reduced, wherein the delaying unit delays a control timing of the switch element such that second resonance noise generated due to energization of the primary current to the primary side coil by the first resonance noise has a reverse phase to a phase of the first resonance noise.

3. The ignition device for an internal combustion engine according to claim 2, wherein the delaying unit causes, when the ignition controlling signal becomes lower than a threshold value, the switching element to interrupt the primary current to the primary side.

4. The ignition device for an internal combustion engine according to claim 1, wherein the delaying unit controls, where the interruption time period is longer than an oscillation period of the first resonance noise, the switch element on the basis of the ignition controlling signal.

5. The ignition device for an internal combustion engine according to claim 1, wherein the delaying unit controls, where the interruption time period is shorter than an oscillation period of the first resonance noise, the switch element on the basis of the ignition controlling signal.

6. The ignition device for an internal combustion engine according to claim 1, further comprising:

a delay amount map in which a delay amount of the control timing of the switch element according to a type of the ignition controlling signal supplied from the electronic controlling device is recorded, wherein the delaying unit selects the delay amount according to the type of the ignition controlling signal on a basis of the delay amount map.

* * * * *